US006247318B1

(12) United States Patent
Stensrud et al.

(10) Patent No.: US 6,247,318 B1
(45) Date of Patent: Jun. 19, 2001

(54) EVAPORATOR DEVICE FOR AN ICE MAKER AND METHOD OF MANUFACTURE

(75) Inventors: Gerald J. Stensrud, Mallard, IA (US); Gerald E. Gregory, Lakewood, CO (US)

(73) Assignee: Mile High Equipment Co., Denver, CO (US)

( * ) Notice: Subject to any disclaimer, the term of this patent is extended or adjusted under 35 U.S.C. 154(b) by 0 days.

(21) Appl. No.: 09/432,651

(22) Filed: Nov. 2, 1999

(51) Int. Cl.[7] ..... F25C 1/12
(52) U.S. Cl. ..... 62/74; 29/890.035; 62/347
(58) Field of Search ..... 62/73, 74, 347, 62/348, 352, 515; 29/890.035, 890.046, 890.047; 165/151

(56) References Cited

U.S. PATENT DOCUMENTS

| | | | | |
|---|---|---|---|---|
| 1,709,865 | | 4/1929 | Muffly . | |
| 3,086,559 | | 4/1963 | Grenell | 138/157 |
| 3,280,588 | * | 10/1966 | Brindley | 62/347 |
| 3,430,452 | | 3/1969 | Dedricks et al. | 62/138 |
| 4,459,824 | | 7/1984 | Krueger | 62/347 |
| 4,720,902 | | 1/1988 | Gray | 29/157.3 |
| 4,898,232 | | 2/1990 | Ochiai et al. | 165/151 |
| 4,903,504 | | 2/1990 | Nelson | 62/347 |
| 4,995,245 | * | 2/1991 | Chang | 62/347 |
| 5,129,237 | | 7/1992 | Day et al. | 62/73 |
| 5,157,941 | * | 10/1992 | Cur et al. | 62/515 |
| 5,186,022 | | 2/1993 | Kim | 62/515 |
| 5,193,357 | | 3/1993 | Kohl et al. | 62/347 |

* cited by examiner

*Primary Examiner*—William E. Tapolcai
(74) *Attorney, Agent, or Firm*—Ohlandt, Greeley, Ruggiero & Perle, LLP

(57) ABSTRACT

An evaporator device for an ice maker with a grid of ice cells in horizontal rows and vertical columns. The grid is formed by a plurality of vertical integral structures interleaved with a plurality of vertical partitions. Each vertical structure is shaped to form the tops, bottoms and backs of the ice cells of a column. The sides of the ice cells of a column are formed by the vertical partitions to the right and left of a vertical structure. An evaporator tube threads bores and holes in the vertical structures and the vertical structures. The evaporator tube is expanded to mechanically bond the evaporator tube with the vertical structures and the vertical partitions.

18 Claims, 4 Drawing Sheets

EVAPORATOR DEVICE FOR AN ICE MAKER AND METHOD OF MANUFACTURE

BACKGROUND OF THE INVENTION

1. Field of the Invention

This invention relates to an evaporator device for ice making equipment and to a method of manufacturing the evaporator device. In particular, the invention relates to an evaporator device that does not use brazing or soldering in a manner that leaves brazing or soldering material in contact with the ice making cells.

2. Description of the Prior Art

Evaporator devices generally include an array of ice cells arranged in a grid of horizontal rows and vertical columns and a refrigerant tube that is positioned adjacent the grid to provide cooling during ice making and heating during defrost and harvest.

It is known to construct an ice cell array with thermally conductive metal, such as copper or aluminum. An example of a copper evaporator device is shown in U.S. Pat. No. 4,459,824. The evaporator device, when constructed of copper, is plated with a suitable metal, such as tin or nickel. The plating is required by Natonal Sanitation Foundation codes, which prohibit the use of copper parts in contact with food products. The plating process results in waste products that need to be handled with environmentally acceptable procedures. In addition, plating degradation can occur at solder fillets used in the construction of the array of cells or their connection to other parts over which the water used in the ice making process may flow. This can result in a formation of copper oxides that could contaminate the ice.

Examples of evaporator devices that use aluminum parts to construct the ice cell array are shown in U.S. Pat. Nos. 3,430,452, 5,129,237 and 5,193,357. For instance, U.S. Pat. No. 5,193,357 discloses a plurality of horizontal integral aluminum pieces arranged side by side to form a grid of ice cells. However, the back of each ice cell contains a gap that is filled entirely or partially with brazing material. Brazing material or soldering material can deteriorate over time, thereby resulting in unreliability. Moreover, the evaporator device construction is limited to one-sided ice cell arrays.

U.S. Pat. No. 5,129,237 discloses an evaporator device constructed of a base plate from which extend row wide fins. Vertical fins must be connected to the row wide fins to form a grid of ice cells. Conventional techniques have included notches. Notch connections are susceptible to loosening and, therefore, present a quality issue. If the notch connection is strengthened by brazing or soldering, the above noted disadvantages will result.

Thus, there is a need for an evaporator device that does not have ice cells formed with copper, brazing material or soldering material.

There is also a need for an evaporator device that has secure fastenings without the use of brazing or soldering.

SUMMARY OF THE INVENTION

The evaporator device of the present invention is used in an ice maker that makes ice cubes. The evaporator device has a plurality of vertical integral structures located side-by-side with a plurality of vertical partitions interleaved therewith to form an array of ice cells in horizontal rows and vertical columns. Each of the vertical integral structures has a plurality of bores extending horizontally therethrough. Each of the vertical partitions has a plurality of holes in registry with the bores. An evaporator tube threads the bores and the holes. The evaporator tube is expanded to mechanically bond the vertical integral structures, the vertical partitions and the evaporator tube.

In preferred embodiments, the vertical integral structures the vertical partitions are aluminum.

Each vertical integral structure includes a base plate and a plurality of fins that extend outwardly from the base plate. The base plate forms the back of each ice cell of one column. Each of the fins has opposed first and second surfaces that form the tops and bottoms of adjacent ones of the ice cells of the column.

A plurality of weep holes is formed in each of the vertical partitions. The weep holes of each vertical partition are in registry with the weep holes of adjacent vertical partitions to form for each horizontal row a weeping passageway for water and air during a defrost/harvest cycle. The passageway is open at its ends to allow the flow of water and air.

The vertical integral structures and the vertical partitions are shaped to support a mirror image array of ice cells in a dual array configuration.

The method of the present invention for making an evaporator device forms the array of ice cells by interleaving the vertical integral structures with the vertical partitions. An evaporator tube is then threaded through the bores of the vertical integral structures and the holes of the vertical partitions. The evaporator tube is then expanded to mechanically bond the evaporator tube, the vertical integral structures and the vertical partitions.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

Figure 1:
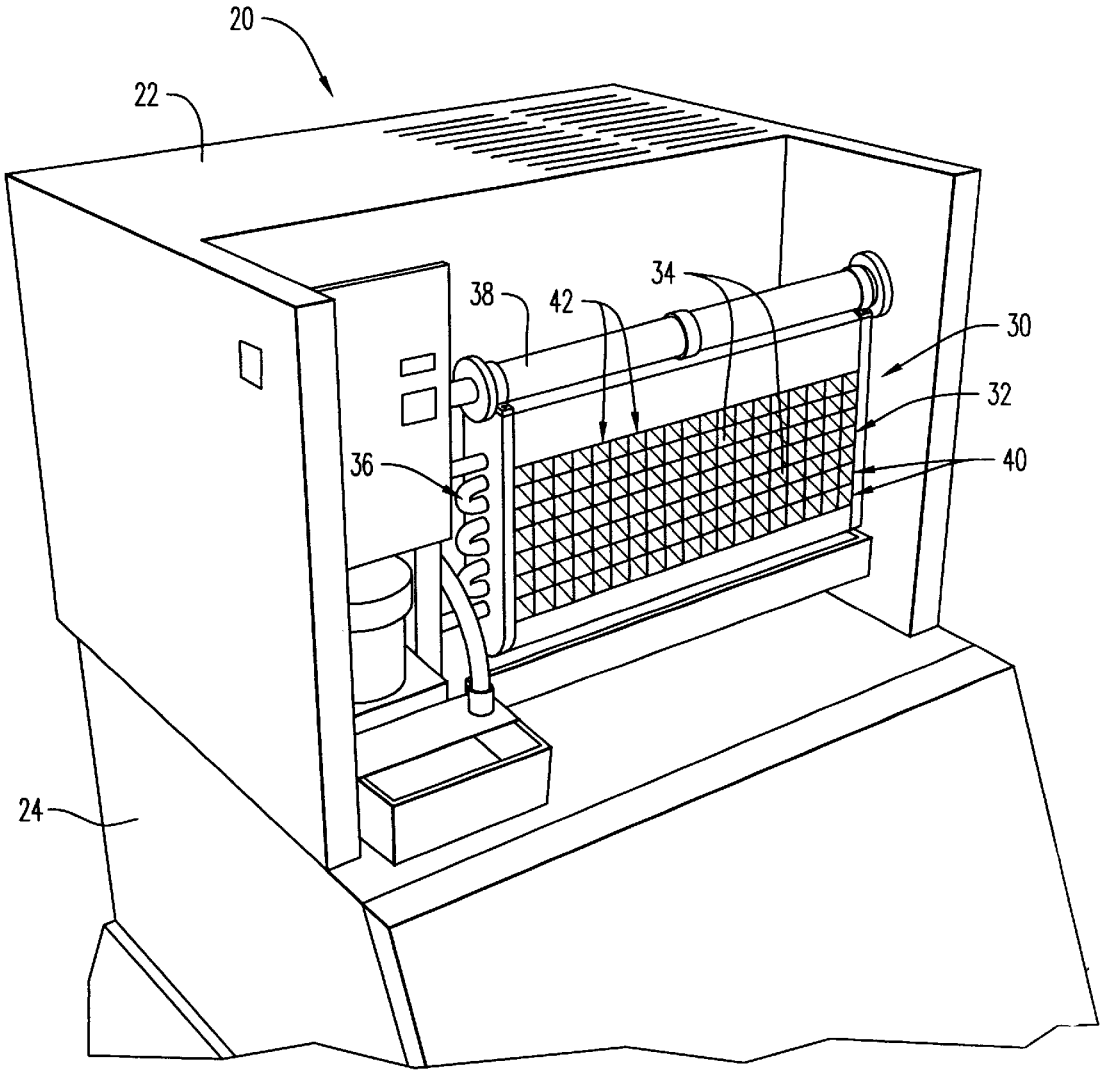
FIG. 1 is a perspective view of an ice maker with an upper panel removed to show the evaporator device of the present invention.

With reference to FIG. 1, there is provided an ice maker 20 having an ice making compartment 22 located in proximity to, for example above, an ice storage compartment 24. Ice is made during an ice making cycle in ice making compartment 22. The ice is transferred by gravity action to ice storage compartment 24 during an ice harvest cycle.

Ice making compartment 22 has its front panel removed in FIG. 1 in order to show an evaporator device 30 according to the present invention. Evaporator device 30 is operable during the ice making cycle to make ice cubes.

Evaporator device 30 includes an array 32 of ice cells 34, an evaporator tube 36 and a water drip tube 38. Evaporator tube 36 is connected to a compressor and condenser assembly (not shown) and water drip tube 38 is connected to a water supply system (not shown), all of which are conventional for ice makers.

Figure 2:
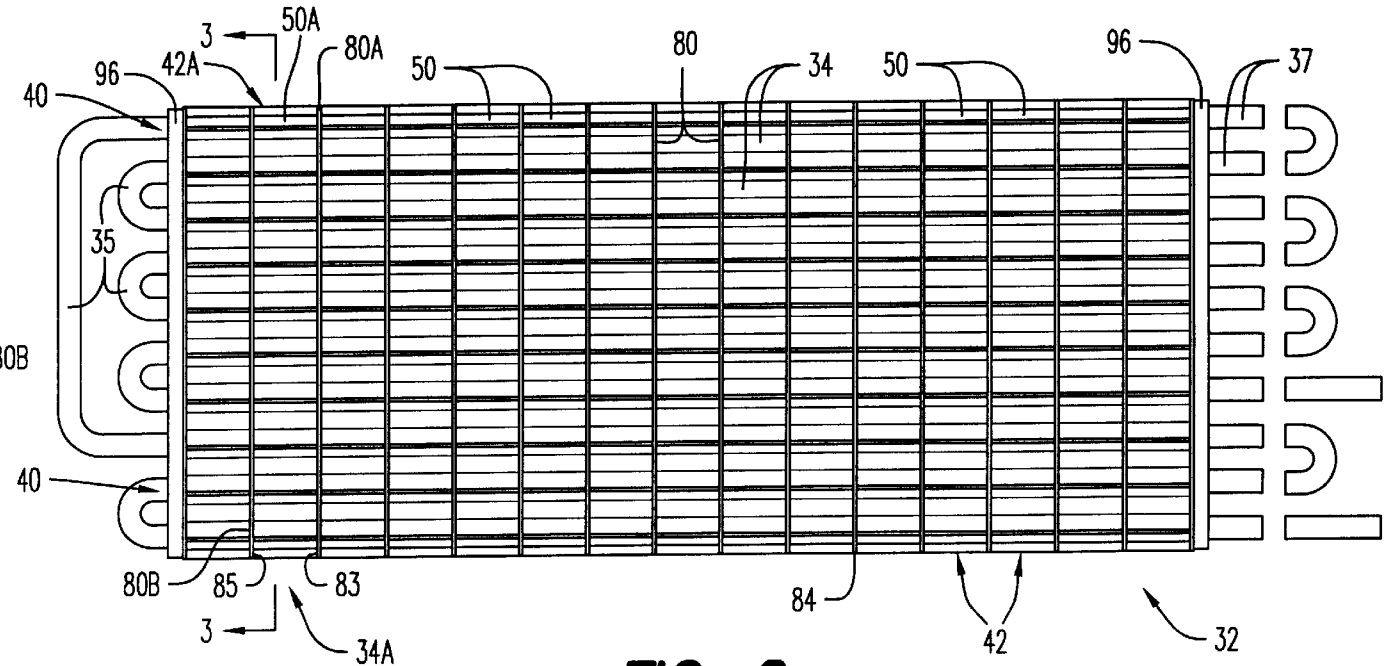
FIG. 2 is a front view of the evaporator device of the present invention.
Figure 3:
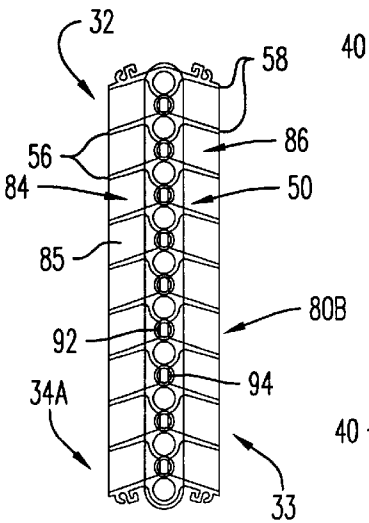
FIG. 3 is a view taken along line 3—3 of FIG. 2.

Referring to FIGS. 1 through 3, ice cells 34 of array 32 are arranged in a grid or matrix having a plurality of horizontal rows 40 and a plurality of vertical columns 42. Disposed directly behind array 32 is another array 33 of ice cells, which is a mirror image of array 32. Arrays 32 and 33 are formed by a plurality of integral vertical structures 50 that are interleaved with a plurality of vertical partitions 80. Thus, a vertical column 42 is formed with an integral vertical structure 50 and two vertical partitions 80 that are disposed on either side thereof.

During the ice making cycle, refrigerant is circulated through evaporator tube 36 to cool ice cells 34. Water drips from drip tube 38 into ice cell arrays 32 and 33. The dripping water trickles through array 32 and freezes to gradually develop an ice cube in each ice cell 34. During the harvest cycle, refrigerant from the discharge side of the system is circulated in evaporator tube 36. This results in a slight melting of each ice cube that allows the ice cube to loosen from its ice cell 34 and fall into storage compartment 24.

Referring to FIGS. 4 through 7, vertical structure 50 has a plurality of bores 52 extending there through in a horizontal direction. Vertical structure 50 includes a base plate 54 with opposed front and back surfaces 57 and 59, respectively. A plurality of fins 56 extend outwardly from front surface 57 into array 32 to define the tops and bottoms of ice cells 34 in a column 42. Another plurality of fins 58 extend outwardly from back surface 57 into array 33 to form the tops and bottoms of a column of ice cells of array 33.

Figure 4:
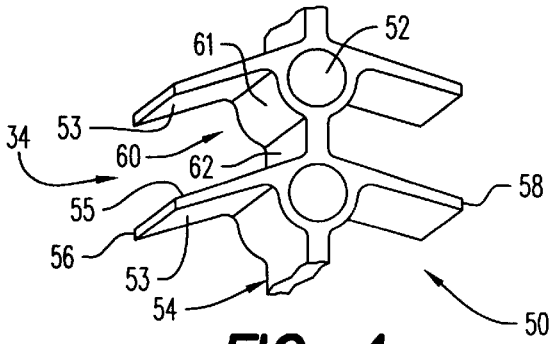
FIG. 4 is a perspective view of a portion of an integral vertical structure that partially forms a vertical column of ice cells of the evaporator device according to the present invention.

As shown in FIG. 4, each fin has a first surface 53 and a second surface 55 that are opposed to one another. Opposed surfaces 53 and 55 form the top and bottom of adjacent ice cells 34 in a vertical column 42. For example, first surface 53 of the upper fin 56 forms the top of ice cell 34. Surface 55 of the next lower fin 56 forms the bottom of ice cell 34. A portion 60 of back plate 54 that extends between adjacent fins forms the back of ice cell 34. Portion 60 has a curved segment 61 and a generally flat segment 62.

Figure 6:
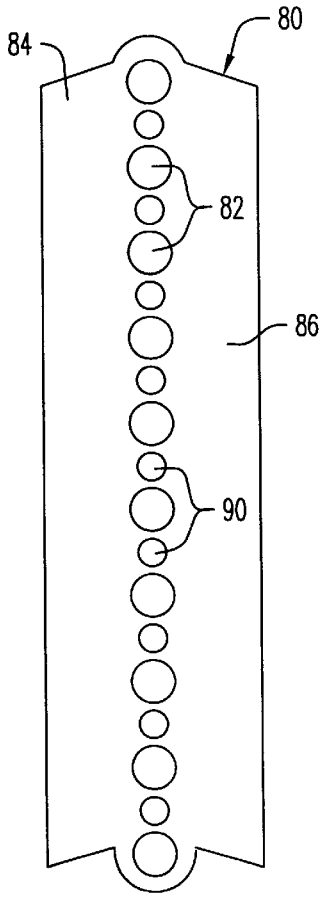
FIG. 6 is a side elevation view of a vertical partition that partially forms a column of vertical cells of the evaporator device according to the present invention.
Figure 7:
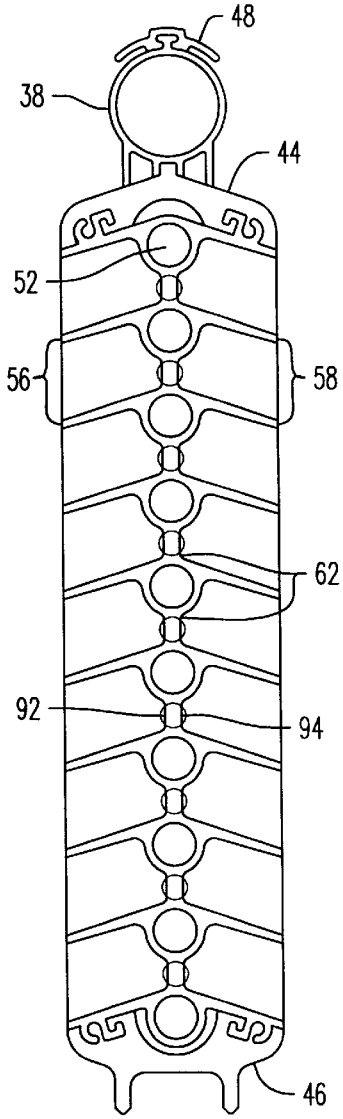
FIG. 7 is a side elevation view of an assembly of the integral structure of FIG. 5 and the vertical partition of FIG. 6.
Figure 8:
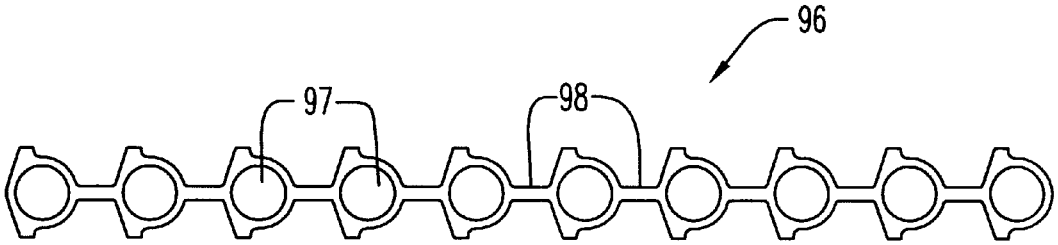
FIG. 8 is a top view of an end piece of the evaporator device of FIG. 6.
Figure 9:
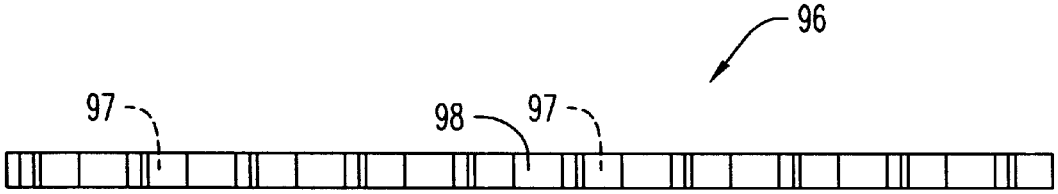
FIG. 9 is a side view of the end piece of FIG. 8.

Referring to FIGS. 3, 6 and 7, partition 80 has a plurality of holes 82 located in a column that are in registry with bores 52 of adjacent vertical structures 50 in arrays 32 and 33. Partition 80 includes a first divider portion 84 that extends into array 32 and a second divider portion that extends into array 33.

An ice cell 34 has its top, bottom and back defined by the vertical structure of its column as described above. The sides of the ice cell are defined by the adjacent partitions 80 to the right and to the left of the vertical structure. For example, with reference to FIGS. 2 and 3, an ice cell 34A in a column 42A of array 32 has its top, bottom and back defined by a vertical structure 50A as described above. A right side of ice cell 34A is defined by a surface 83 of a partition 80A located immediately adjacent the right of vertical structure 50A. A left side of ice cell 34A is defined by a surface 85 of partition 80B located immediately adjacent the left of vertical structure 50A. Similarly, all of the ice cells 34 in column 42A are defined by vertical structure 50A, surface 83 of partition 80A and surface 85 of partition 80B.

Each ice cell 34 of a horizontal row 40 is defined by a different vertical structure 50. Thus, ice cell 34A is defined by vertical structure 50A. The vertical structure 50 to the immediate right of vertical structure 50A defines the ice cell 34 to the immediate right of ice cell 34A. Partition 80A defines the right side of ice cell 34A and the left side of the ice cell to the immediate right of ice cell 34A.

Referring to FIG. 4, the cross sections of fins 56 and 58 are generally tapered from base plate 54 to their tips. For example, surface 55 of fin 56 has a slight angle of about 18° so as to release an ice cube during the harvest cycle. Surface 53 has a slight angle of about 15° to assure that water penetrates to the rear of ice cell 34.

Figure 5:
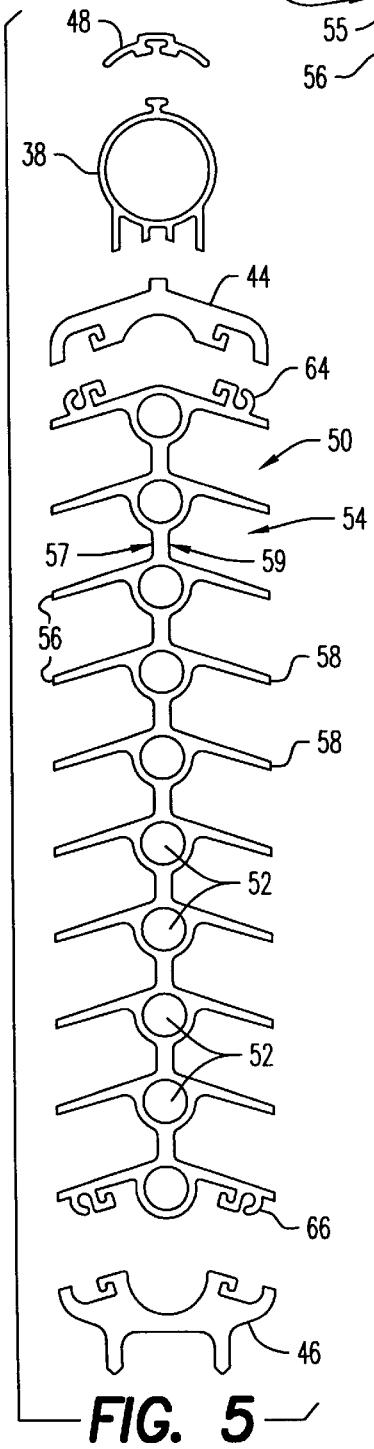
FIG. 5 is a side elevation view of the integral vertical structure of FIG. 4.

With reference to FIGS. 5 and 7, vertical structure 50 has an upper mount 64 and a lower mount 66. A water drip distributor 44 is secured to upper mount 64 and a catch water drip element 46 is secured to lower mount 66. Water drip tube 38 is secured to the top of water drip distributor 44. A water vane 48 is secured to the top of water drip tube 38 to direct water exiting drip tube 38 to flow around its circumference in both directions so as to then be directed by water drip distributor 44 to arrays 32 and 33.

Referring to FIGS. 3, 6 and 7, each partition 80 has a plurality of weep holes 90 in alignment with flat portions 62 of base plate 54. Weep holes 90 have a large enough diameter to straddle flat portions 62 of each ice cell so as to form a horizontal weep passageway 92 for each horizontal row 40 of array 32 and a horizontal weep passageway 94 for each horizontal row 40 of array 33. Horizontal weep passageways 92 and 94 extend the entire length of each horizontal row 40 and provide a path for melting water to escape at the ends of the row during the melt or defrost mode of the harvest cycle. This construction permits the use of vertical structures 50 and partitions 80 in a dual sided evaporator device.

Vertical structures 50 are formed with an extruded high density, non-porous material, such as aluminum. Partitions 80 are also formed of aluminum sheet material with holes 82 and 90 being formed, for example, by a punching operation. Evaporator tube 36 may suitably be copper as it will not form any of the surfaces of an ice cell upon which an ice cube is formed.

With reference to FIG. 2, a method of manufacturing evaporator device 30 according to the present invention begins with anodizing the aluminum parts, namely vertical structures 50 and partitions 80. Vertical structures 50 and partitions 80 are then interleaved with bores 52 and holes 82 in registry with one another. The subassembly so formed is clamped and horizontal lengths 37 of evaporator tube 36 are threaded through each horizontal row of bores 52 and holes 82.

Figure 10:
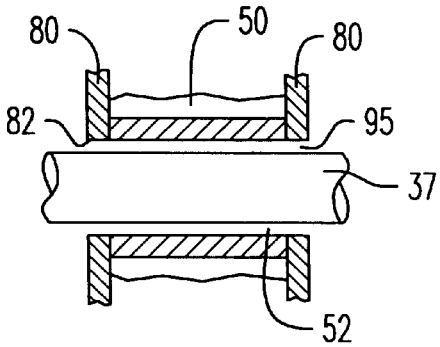
FIG. 10 is an exploded cross-sectional view of an unexpanded joint of the evaporator device.
Figure 11:
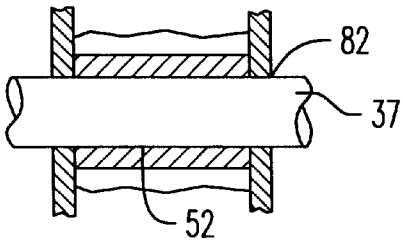
FIG. 11 is an exploded cross-sectional view of an expanded joint of the evaporator device.

An expansion process is then performed row by row to expand evaporator tube horizontal lengths so as to form mechanically bonded joints of tubing lengths 37 to vertical structures 50 and partitions 80. For example, one conventional expansion process involves passing a ball through each tubing length 37 to thereby expand the tubing length. An example of an unexpanded joint is shown in FIG. 10. This view has been exploded to show a slight tolerance spacing 95 between tube length 37 and the interior diameter of bore 52 and hole 82. An example of an expanded joint is shown in FIG. 11. The tubing length 37 is now expanded, tolerance space 95 is eliminated and a mechanical bond is formed among tubing length 37 and the interior surfaces of bore 52 and hole 82.

A row terminator 96 is then installed at either end of the assembly. With reference to FIGS. 2, 4, 8 and 9, row terminator 96 has a plurality of holes 97 located in registry with bores 52 and holes 82. Between each of the holes 97 is a generally flat portion 98 of substantially the same thickness dimension as flat segment 62 of vertical structures 50. This assures that weep passageways 92 and 94 will be through from end to end of the horizontal rows to allow melted water to escape during the defrost/harvest cycle and drip down the outer surface of row terminators 96. Terminators 96 also provide structural support on the ends of ice cell arrays 32 and 33, especially for the partitions 80 that are located at the ends of each horizontal row 40.

The tubing lengths 37 are formed into a serpentine coil by soldering hairpin forms 35 to the open ends of tubing lengths 37, except for the ends that will be connected to the refrigerant system. This soldering takes place beyond terminators 96 and totally outside the area where water trickles through arrays 32 and 33. To complete the assembly, vertical end pieces (not shown) may be secured to either end of the assembly.

The advantages of the evaporator device of the invention will be apparent to those skilled in the art. The number of aluminum parts for arrays 32 and 33 is limited to n vertical structures 50 and n+1 partitions 80, where n is the number of columns in array 32 or array 33. Only aluminum surfaces form ice cells 34 and only aluminum surfaces and plastic terminators 96 are in contact with water. No soldering, brazing or plating is required within ice cell arrays 32 or 33. Soldering or brazing occurs only for adding hairpin forms to the ends of evaporator tubing lengths 37. This occurs well outside the area where water flows or trickles through arrays 32 or 33.

The present invention having been thus described with particular reference to the preferred forms thereof, it will be obvious that various changes and modifications may be made therein without departing from the spirit and scope of the present invention as defined in the appended claims.

What is claimed is:

1. An evaporator device for an ice maker, said evaporator device comprising:

a plurality of vertical integral structures located side-by-side with a plurality of vertical partitions interleaved with said plurality of integral structures to form an array of ice cells in horizontal rows and vertical columns;

each of said vertical integral structures having a plurality of bores extending horizontally therethrough and each of said vertical partitions having a plurality of holes in registry with said bores; and an evaporator tube threading said bores and said holes, wherein each of said ice cells has a back, a top and a bottom formed by one of said vertical integral structures and a pair of sides formed by adjacent ones of said vertical partitions.

2. The evaporator device of claim 1, wherein said vertical integral structures are aluminum.

3. The evaporator device of claim 2, wherein said evaporator tube is expanded to mechanically bond said vertical integral structures, said vertical partitions and said evaporator tube.

4. The evaporator device of claim 1, wherein each of said plurality of vertical integral structures includes a base plate and a plurality of fins that extend outwardly from said base plate, said base plate forming the back of each ice cell of one column of said plurality of columns, each of said fins having opposed first and second surfaces that form the tops and bottoms of adjacent ones of the ice cells of said one column.

5. The evaporator device of claim 4, wherein said fins are inclined downwardly at a slight angle for gravity assistance of ice removal for a harvest mode operation.

6. The evaporator device of claim 4, wherein a plurality of weep holes are formed in each of said vertical partitions, the weep holes of each vertical partition being in registry with the weep holes of adjacent vertical partitions to form for each horizontal row a weeping passageway for water and air during said harvest mode operation, said passageway being open at its ends to allow the flow of water and air.

7. The evaporator device of claim 2, wherein said array of ice cells includes a front array of ice cells in horizontal rows and vertical columns and a back array of ice cells in horizontal rows and vertical columns.

8. The evaporator device of claim 7, wherein said evaporator tube is expanded to mechanically bond said vertical integral structures, said vertical partitions and said evaporator tube.

9. The evaporator device of claim 7, wherein each of said plurality of vertical integral structures includes a base plate with opposed front and back surfaces, a plurality of front fins that extend outwardly from said front surface and a plurality of back fins that extend outwardly from said back surface;

wherein said front surface forms the backs of each ice cell of one column of said plurality of columns of said front array and said back surface forms the backs of each ice cell of one column of said plurality of columns of said back array; and wherein each of said front fins have opposed first and second surfaces that form the top and bottom of adjacent ones of the ice cells of said one column of said front array and each of said back fins have opposed first and second surfaces that form the top and bottom, respectively, of adjacent ones of the ice cells of said one column of said back array.

10. The evaporator device of claim 7, wherein said plurality of vertical partitions define a front weep passageway for each of the rows of said front array and a back weep passageway for each of the rows of said back array, each of said front and back weep passageways extending the entire length of said rows for the flow of water and air during a defrost/harvest cycle of operation.

11. The evaporator device of claim 10, wherein each of said plurality of vertical partitions includes a plurality of weep holes, said weep holes being located to form said front and back weep passageways.

12. The evaporator device of claim 11, wherein each of said weep holes straddles adjacent ones of said vertical integral structures.

13. The evaporator device of claim 12, wherein each of said vertical integral structures includes a base plate and wherein each of said weep holes straddles adjacent ones of said base plates.

14. A method of making an evaporator device for an ice maker, said evaporator device having a plurality of ice cells arranged in an array having horizontal rows and vertical columns, said method comprising:

(a) forming said array of ice cells with a plurality of vertical integral structures interleaved with a plurality of vertical partitions, wherein each of said vertical integral structures forms a top, bottom and back of each ice cell in one of said columns, each of said vertical integral structures having a plurality of horizontal bores extending therethrough, each of said vertical partitions having a plurality of holes in registry with said bores; and (b) threading said bores and said holes with an evaporator tube.

15. The method of claim 14, wherein said vertical integral structures and vertical partitions are aluminum and said evaporator tube is copper, and further comprising:

(c) expanding said evaporator tube to mechanically bond said evaporator tube, said vertical integral structures and said vertical partitions.

16. The method of claim 15, wherein each ice cell in a column has a pair of sides formed by adjacent ones of said vertical partitions.

17. The method of claim 16, wherein each of said vertical partitions have a plurality of weep holes, each of said weep holes being aligned with the ice cells of a horizontal row to allow the formation of a weep passageway during a defrost/harvest mode of operation of said ice maker.

18. An evaporator device for an ice maker, said evaporator device comprising:

a plurality of vertical integral structures located side-by-side with a plurality of vertical partitions interleaved with said plurality of integral structures to form an array of ice cells in horizontal rows and vertical columns;

each of said vertical integral structures having a plurality of bores extending horizontally therethrough and each of said vertical partitions having a plurality of holes in registry with said bores; and an evaporator tube threading said bores and said holes, wherein said vertical integral structures are aluminum, and wherein said evaporator tube is expanded to mechanically bond said vertical integral structures, said vertical partitions and said evaporator tube.

* * * * *